United States Patent [19]

Hinman et al.

[11] 4,327,505

[45] May 4, 1982

[54] REMOTELY STEERABLE DREDGE VEHICLE

[75] Inventors: Mark H. Hinman, Seaford; John P. Latimer, Newport News, both of Va.

[73] Assignee: Deepsea Ventures, Inc., Gloucester Point, Va.

[21] Appl. No.: 160,947

[22] Filed: Jun. 19, 1980

[51] Int. Cl.[3] ..... E02F 3/88

[52] U.S. Cl. ..... 37/54; 37/DIG. 8; 280/24

[58] Field of Search ..... 180/132, 162; 280/12 AA, 12 KL, 21 R, 24; 299/8; 37/DIG. 8; 114/144 A, 61, 244, 245; 37/58, 72, 54

[56] References Cited

U.S. PATENT DOCUMENTS

| | | | |
|---|---|---|---|
| 3,365,823 | 1/1968 | Vogt | 299/8 X |
| 3,504,943 | 4/1970 | Steele et al. | 37/59 X |
| 4,026,049 | 5/1977 | Johnson | 37/72 X |
| 4,208,813 | 6/1980 | Latimer | 37/58 |
| 4,249,324 | 2/1981 | Latimer | 37/58 |

*Primary Examiner*—Joseph F. Peters, Jr.
*Assistant Examiner*—Michael Mar
*Attorney, Agent, or Firm*—Barry G. Magidoff

[57] ABSTRACT

A dredge vehicle having remote steering for moving on the ocean floor on a skid surface, or preferably a pair of runners. The steering is provided by a steering member extending downwardly below the bottom surface of the skid surface into the mud on the ocean floor, which can be moved so as to vary the resultant sideways force exerted against a surface of the member. The movement is provided by pivotally connecting the steering member to the dredge vehicle about a vertical axis. Specifically, the steering member can be rotated by an hydraulic cylinder. Preferably, the downwardly extending steering member is also vertically movably secured to the dredge vehicle so as to be able to be pushed upwardly and out of the way should the steering member strike against a submerged, hard-surfaced object. Preferably, at least a pair of pivotable steering members disposed in tandem are provided.

22 Claims, 11 Drawing Figures

A
B
10
11
12
13
14
15
16
17
18
19
20
21
22
23
24
25
26
115
3

REMOTELY STEERABLE DREDGE VEHICLE

This invention provides a remotely steerable dredge vehicle, and the like, which is moved, on a skid surface preferably by towing means connected to a surface vessel, along the bottom of the sea.

With the coming shortage of land-based, high grade metal ores, miners are turning to new sources of such metals, including especially the bottom of the sea. It has been known for almost a century now that small, generally fist-sized particles of relatively high grade manganese ore, containing in addition valuable quantities of nickel, copper, cobalt and other metals, can be readily obtained by simply dredging the bottom of the ocean. However, the major problems of reaching the depths at which such nodule ores are found in sufficient concentration to be economic, and the problems of refining these ores, have prevented, up to now, the commercial exploitation of this resource.

The art has developed a variety of means for removing these ores from the floor of the oceans and bringing them to the surface, from which they can be refined into the desired valuable metals. Generally, these ores cannot be obtained in commercial quantities at ocean floor depths much above 12,000 feet. It is anticipated that most future mining of the seas will take place at depths of between 12,000 and 20,000 feet beneath the surface of the ocean. Thus, the difficulties of obtaining these ores have been a major problem in preventing their commercial exploitation. Most of the anticipated means for reaching the ocean floor include a device, such as a dredge head, intended to move along the floor of the ocean, towed by a surface vessel. Such vessels can move along the ocean floor on runners, or other skid surface or surfaces. Such dredge devices preferably are not self-propelled, but towed, the motive force being conveyed from the surface of the ocean via a cable and/or a rigid tubular member, such as a pipe. The rigid pipe can also serve as a means for transporting the collected ores from the dredge head up to the surface, as by an airlift system.

In the towed type of dredge vehicle, regardless of the supporting means between the vehicle and the ocean floor, the primary steering means is provided by the connection between the surface vessel and the dredge, which provides the towing force to the dredge. The problems of steering the dredge over the ocean floor is compounded by the extreme length of such a tow line, in that the avoidance or relatively small obstacles on the ocean floor can require a major change in direction of the towing surface vehicle. Those dredge veicles which are primarily self-propelled, i.e., such as the wheeled vehicle disclosed by U.S. Pat. No. 3,504,943, have articulated members, or means for changing the relative speed of rotation of the wheels or treads on either side of the dredge vehicle, to provide the desired steering. However, the problem remains that the towed vehicles are the simplest vehicles to operate and, therefore, the cheapest to construct and maintain, with the least complications and thus smallest chance of becoming disabled. However, steering these toward dredge vehicles has remained a substantial problem preventing, or severely limiting, the commercial use of such towed vehicles for exploiting the ores on the ocean bottom. A remotely controlled steering bridle, wherein the geometry of the bridle can be varied by remote control, has been proposed for the connection between the main tow line and the dredge vehicle. Changing the geometry of the bridle causes the skewing of the dredge vehicle relative to the tow line and the desired change in direction. Such a device is shown in application Ser. No. 910,080 of May 26, 1978 now U.S. Pat. No. 4,208,813, and No. 33,333, filed Apr. 25, 1979 now U.S. Pat. No. 4,249,324.

The abyssal floor of the ocean generally comprises an accumulation of aeons of organic ooze and mud covering the bedrock. The upper 9 to 18 inches, approximately, are sufficiently soft that a skid or runners supporting a relatively heavy-moving vehicle would tend to cut at least slightly into the upper surface, much in the way of a gooey or soft mud, on the land. The nodule ore materials are generally found partly embedded in the soft mud and must be removed therefrom by the dredge. The support surface for the dredge vehicle, it is preferred, does not sink too deeply into this mud surface, but can penetrate it slightly. The skid surface should have sufficient area to ride on the mud material.

In accordance with the present invention, there is now provided a dredge vehicle, having a skid surface support means, intended to be towed on the ocean floor, which can be remotely steered from a surface towing vessel, without requiring any change in direction of the surface vessel, in order to avoid relatively small obstacles on the ocean floor, by varying the resultant sideways force exerted against a steering surface extending downwardly below the skid surface supporting the dredge vehicle. The steerable dredge vehicle comprises a relatively rigid chassis frame for the dredge; a support surface below and secured to the chassis frame; and a steering member rotatably connected to the dredge vehicle and extending downwardly below the support surface, the steering member being longitudinally elongated, and in one position extending substantially parallel to the centerline of the support surface. Preferably, there is also provided a second downwardly extending rotatable steering member, the two steering members most preferably being located in tandem, e.g., one being closer to the tow line connection than the second. Remotely controllable means are provided for rotating the steering member, about a vertical axis, i.e., about an axis substantially perpendicular to the skid surface.

Rotating the steering member relative to the support surface causes a change in the angle of movement of the support surface relative to the tow line, and thereby permits independent steering of the dredge vehicle relative to the towing vessel.

Most preferably, there is also provided means to permit the automatic upward retraction of each steering member in the event of contact with a hard-surfaces obstacle.

Preferred embodiments of the present invention are described hereafter by way of example with reference to the accompanying drawings. These embodiments are merely exemplary and are not intended to be exclusive of the invention.

Referring to the accompanying drawings.

Figures 1, 2, 3:
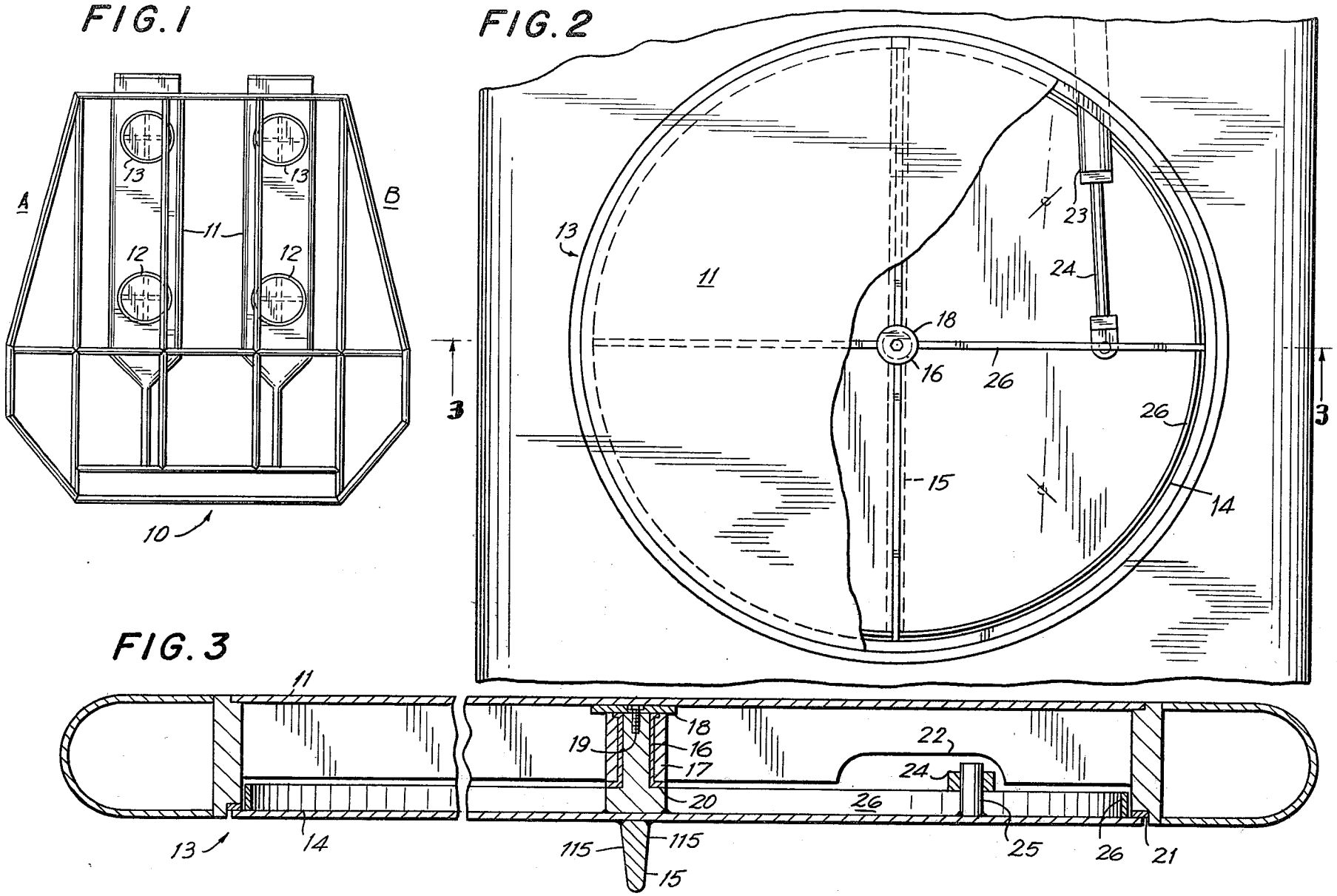
FIG. 1 is a top plan view depicting a dredge vehicle chassis.
FIG. 2 is a top plan view of a rear portion of the support runners of the vehicle of FIG. 1, partially cutaway.
FIG. 3 is a cross-sectional view along lines 3—3 of FIG. 2.

A dredge vehicle chassis frame, generally indicated by the numeral 10, is supported by a pair of skids, or runners 11. The dredge vehicle chassis is intended to be connected to a length of pipe or hose, while moving along the ocean floor, the upper end of the pipe or hose being secured to a moving surface vessel, not shown. The chassis frame is intended to carry dredging means, preferably a suction-type dredge nozzle, and optimally a plurality of such nozzles arranged so as to extend forwardly of the runners 11.

Each runner 11 has, in this embodiment, a substantially flat lower surface extending longitudinally from the front to the rear of the chassis 10. The runners 11, in this embodiment, are substantially identical, each being adjacent a pair of rotating steering members, generally indicated by the numerals 12 and 13, arranged in tandem.

Referring to the first embodiment of FIGS. 2 and 3, each steering mechanism 12, 13 comprises a rotating disk 14, rotatably secured within a concavity in the lower portion of the runner 11 by a disk shaft 16 rotating within a shaft bearing 17 (e.g., a cutlass bearing) and providing a downwardly extending steering member 15. The steering member 15 extends across the entire diameter of the disk 14 and has major side surfaces 115, which in this embodiment slant inwardly, downwardly towards each other, but alternatively can also be parallel to each other and extend directly vertically downwardly, substantially perpendicular to the lower surface of the rotating disk 14 and the remaining undersurface of the runner 11. As shown, the rotating disk is held in place by a retaining disk 18, which extends over a shoulder on the runner 11 and is secured to the shaft 16 by machine screw 19. The outer circumference of the upper surface of the disk 14 abuts against a bearing surface 21, secured to a lower shoulder on the runner 11; the bearing 21 serves to diminish friction between the disk 14 and the runner 11 and also to act as a seal to exclude mud or other detritus from entering the concavity within which the disk 14 rotates, to prevent a jamming of the mechanism. The relatively thin disk 14 is stiffened by upwardly extending ridges 26. As shown, the lower surface of the disk 14 is substantially parallel to, and forms a single flat surface with the lower surface of the runner 11.

The rotating disk 14 is caused to rotate by an hydraulic cylinder 23 secured within a secondary concavity defined by a surface 22 in the bottom surface of the runner 11. The hydraulic cylinder 23 is connected to a cylinder rod 24, which is in turn pinned, by pin 25, to a stiffening ridge 26 on the upper surface of the disk 14. The position of the steering member 15 in FIGS. 1 through 3 is substantially parallel to the centerline of the runner 11, so as to permit straightaway movement of the sled as it is towed by the dredge pipeline. The cylinder rod 24 can be moved inwardly or outwardly relative to the cylinder 23, from the position shown.

Figure 4:
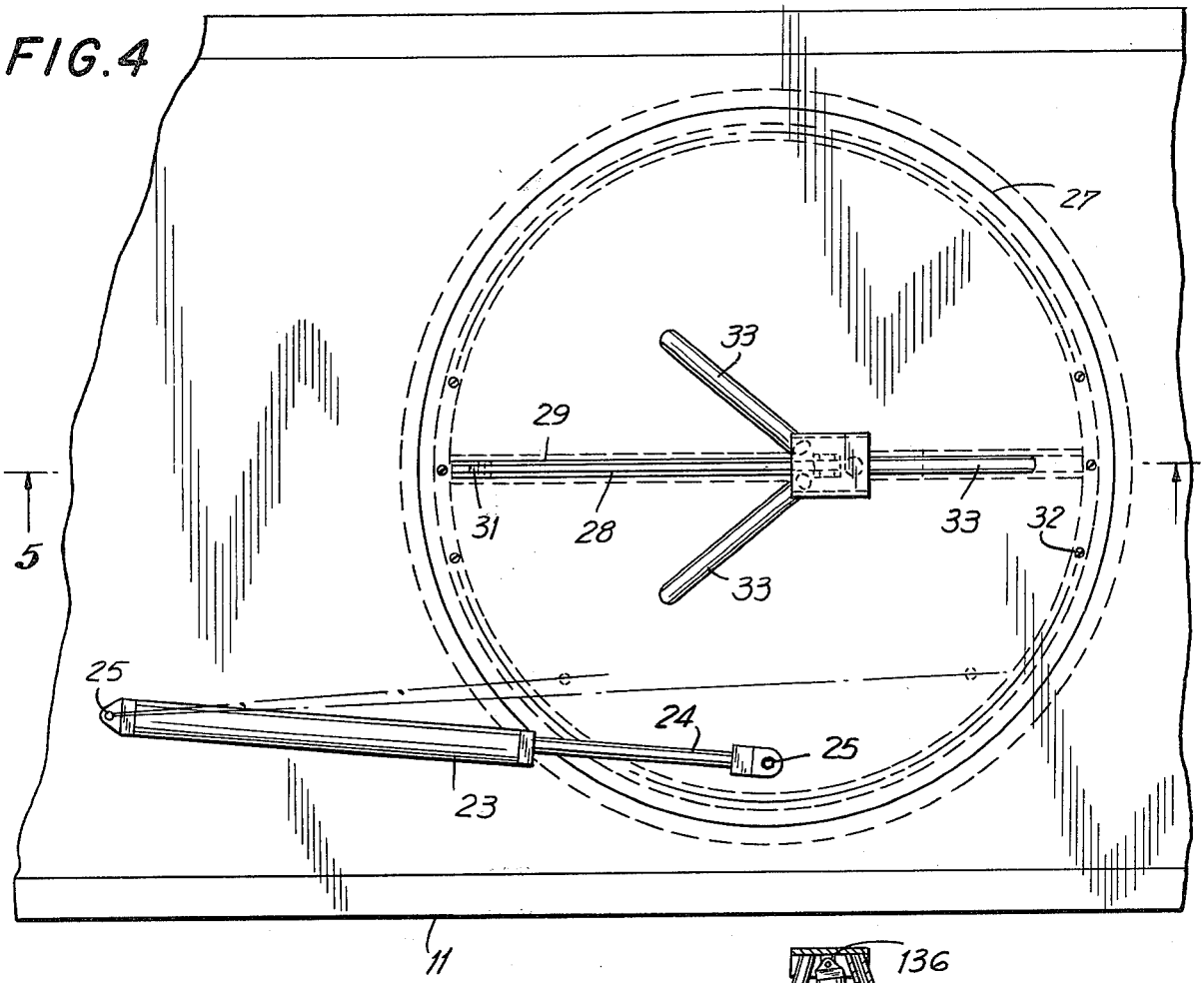
FIG. 4 is a top plan view of a second embodiment of the steering feature of this invention.
Figure 5:
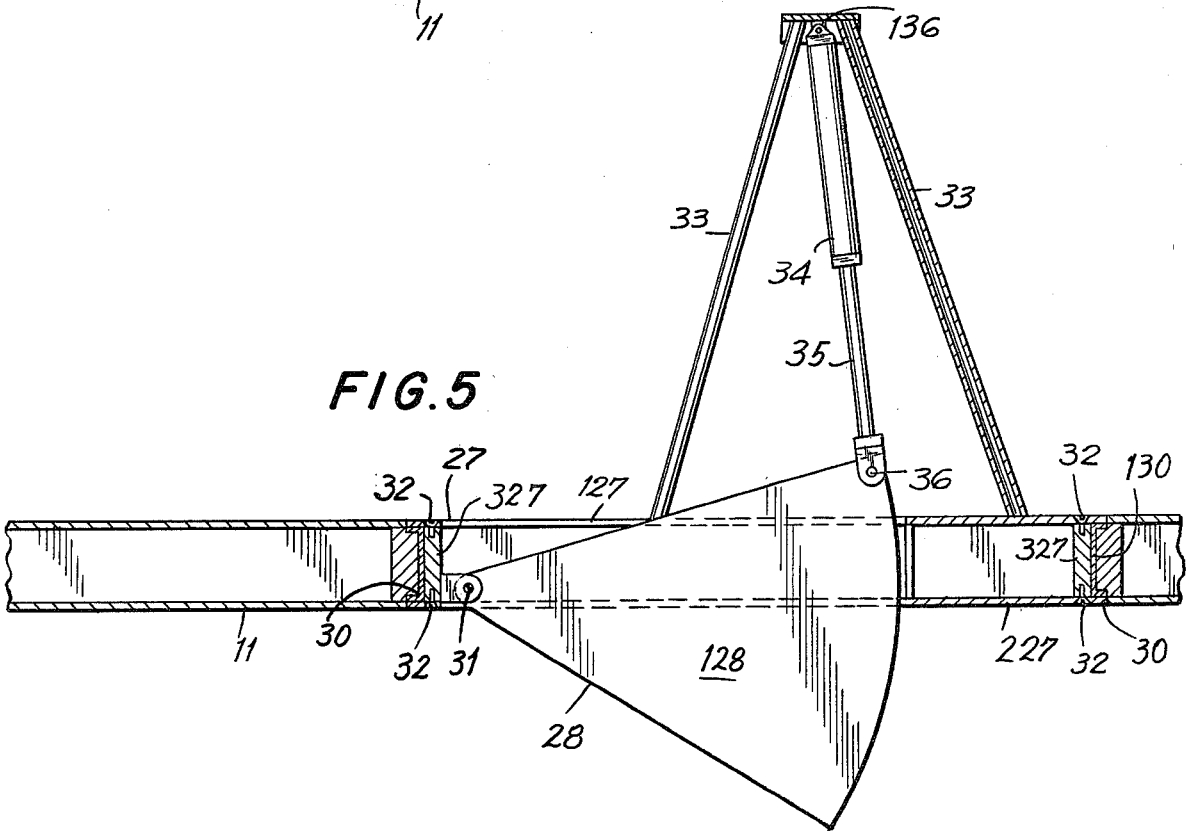
FIG. 5 is a cross-sectional view taken along lines 5—5 of FIG. 4.

The embodiment of FIGS. 4 and 5 provides for the protection of the steering members in the event of contact with a hard, immovable surface. The steering members are placed on the runners 11 in the same relative positions as shown in FIG. 1. The rotating disk, as shown in FIG. 4, comprises a rotating disk-shaped plug 27 extending substantially the full thickness of the runner 11, fitted within a complementary disk-shaped opening cut through the runner 11 and defined by substantially vertical, internal, circumferential bearing surfaces 130. A movable, vertically extending steering member 28 is pivotally connected at its forward portion by pin 31, to the disk 27, with a slot 29 extending along a diameter through the disk 27. The rearward upper corner of the steering member 28 is also pivotably supported on hydraulic cylinder rod 35 by pin 26. The cylinder rod 35 is movably secured within an hydraulic cylinder 34, which is in turn supported upon the upper surface of the disk 27 by tripod legs 33, the cylinder being pinned to the legs 33 by pin 136. The plug disk 27 has secured to its outer circumference a bearing surface 30 (formed for example of a synthetic polymer such as Delrin) and secured to the disk between upper plate 127 and lower plate 227 which are in turn secured to an annular member 327 by machine screws 32.

Rotation of the disk plug 27 is obtained through the operation of the hydraulic cylinder 23 pinned at one end to the top of the runner 11 by pin 25, acting upon hydraulic cylinder rod 24 which is pinned at the opposite end, by pin 25, to the upper surface of the rotating disk 27.

The dredge vehicle is preferably not buoyant, or made so by the addition of dense material, so that it does not float in the sea water. The dredge vehicle is intended to be supported on the runners' support surfaces, which rest upon the ocean floor during operation.

In operation, the rotating steering members 15, in FIGS. 1–3, in the positions in FIG. 1, extend downwardly into the mud on the ocean floor and serve to keep the dredge vehicle moving in a straight line. By rotating the disks 14, upon actuating the hydraulic cylinder 23 and causing the cylinder rod 24 to push the disk 14 in the desired direction, the steering member 15 is rotated so as to extend along a direction oblique to the direction of the stabilizer member 12. This causes net sideways forces against the steering members, causing the dredge vehicle to turn in a desired direction. For example, rotating the steering members 13 in a clockwise direction, and the steering members 12 in a counterclockwise direction, from that shown in FIGS. 1 through 3, will cause the dredge vehicle to steer towards the side B, in FIG. 1. Rotating the steering members 13 in the counterclockwise direction and steering members 12 in a clockwise direction from that shown, will cause the dredge vehicle to turn towards the side A in FIG. 1. In the embodiment shown, having two runners, it is anticipated that the disks 14 will be substantially simultaneously and equally rotated so as to cause an even turning of the vehicle 10.

Referring to FIGS. 4 and 5, the steering operation is substantially identical. The primary difference is that in the event the runners encounter a submerged, immovable, hard-surfaced object, the downwardly extending steering members 28 can move upwardly when their forwardly facing, angled lower edge strikes against a hard object, so as to permit the runners to more easily ride over any submerged hard object. The upward movement of the vertically extending members 28 and 37 is made against the downward biasing force exerted by the hydraulic cylinders 34. After passing over the hard object, the downward force of the hydraulic cylinder 34 will force the rod 35 to move downwardly. It is desirable that the steering members 28 be capable of moving completely upwardly through the corresponding slots, such that a substantially flat surface is presented by the bottom of the runners 11 to any submerged obstruction.

Figure 6:
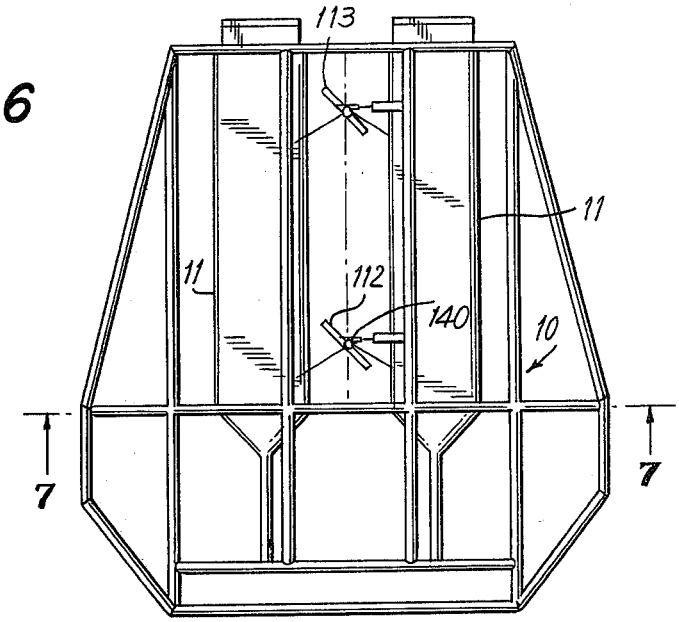
FIG. 6 is a top plan view of a dredge vehicle including an alternative embodiment of steering members.
Figure 7:
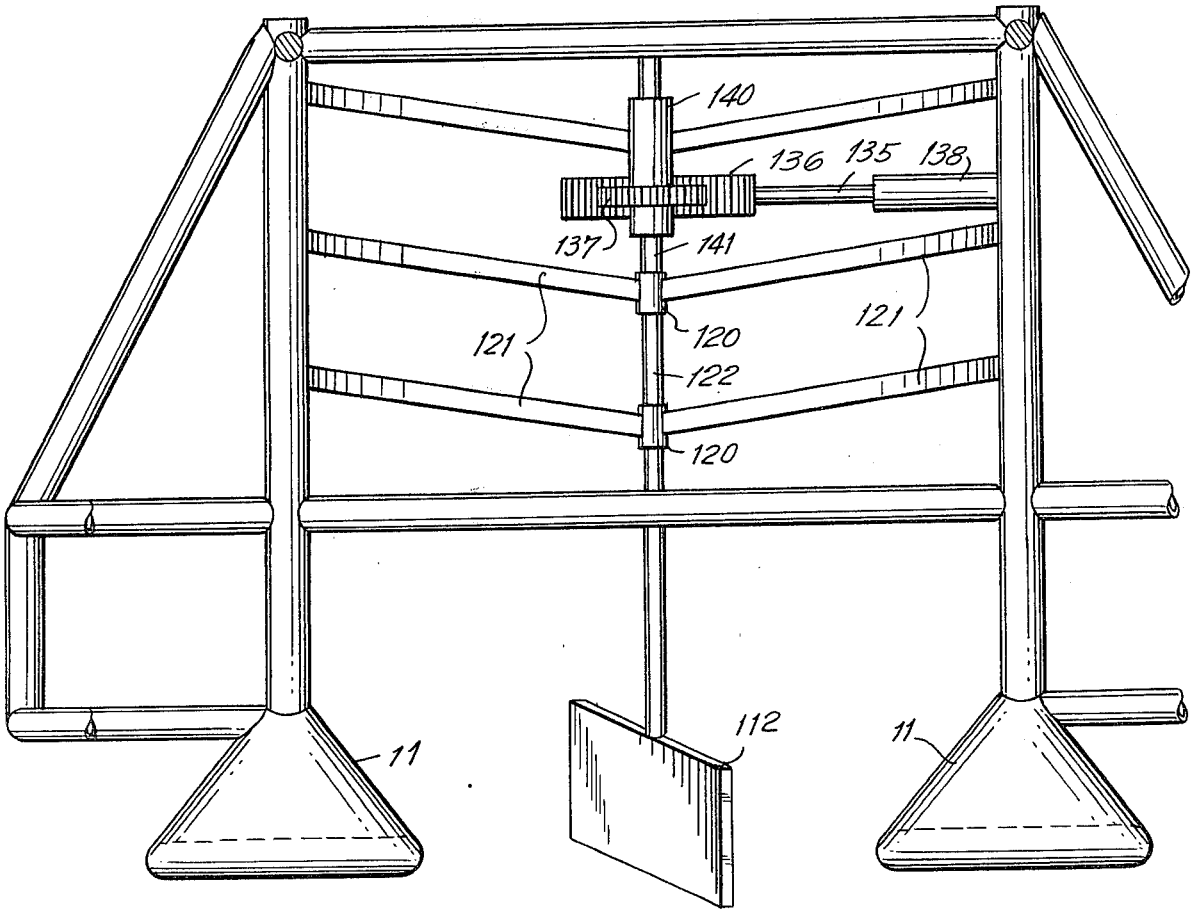
FIG. 7 is a section view along lines 7—7 of FIG. 6.
Figure 9:
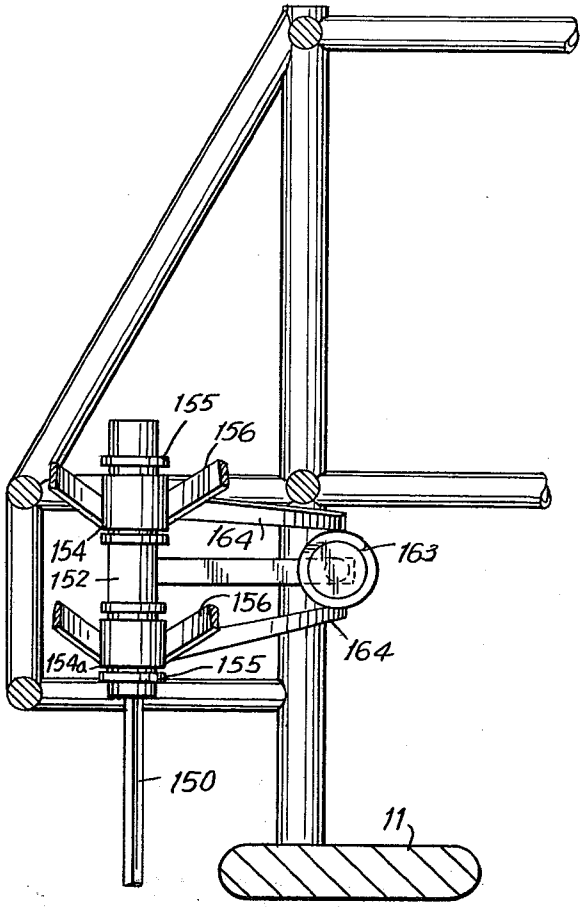
FIG. 9 is a section view of the dredge vehicle along lines 9—9 of FIG. 8 showing the steering mechanism.

The alternative embodiment of FIGS. 6 and 7 show a single pair of steering members 112, 113 in tandem, supported directly from the dredge vehicle chassis frame 10, externally of the runners, and located midway between the two runners. The steering members 112, 113 are pivotably secured, each by a vertical shaft 122 to a pair of vertically aligned bearings 120, which are supported directly from chassis frame struts 121. A horizontally disposed hydraulic piston rod 135 is secured to a horizontal geared pawl 136, which is in turn in meshing contact with a rachet gear 137 secured on each vertical shaft 122; an hydraulic cylinder 138 is operatively connected to the rod 135 and can be remotely controlled to reciprocally move the pawl 136, and thus to rotate the shafts 122 and their steering members 112, 113. The upper end of the shafts 122 can also connect, in line, to a vertically aligned hydraulic dashpot 140, which biases the shaft 122 into its downward position. The shaft 122 can slide vertically within the bearings 120 and relative to the rachet gear 137. A key slot is formed through the rachet 137, through which passes the shaft 122, having a complementary, vertically extending spline 141.

The operation of the alternative embodiment of FIGS. 6 and 7 is substantially the same as explained above for FIGS. 1 through 5; the steering members 112, 113 are rotated to steer the dredge, and are upwardly movable in response to a submerged object, in opposition to the biasing force of the hydraulic dashpot 140.

The alternative embodiment of FIGS. 8–11 shows two pairs of steering members, in tandem, located externally of the runners 11, and supported directly by the dredge vehicle chassis 10. The steering blades 150, 151 are fixedly attached to steering shafts 152. The upper and lower portions of each steering shaft are surrounded by a steering shaft bearing sleeve **154, 154*a*; each shaft bearing sleeve 154, 154*a* is held in place along the vertical axis of the shaft by two shaft collars 155; the steering shaft bearing sleeves permit the steering shafts 152 to rotate. Each steering shaft bearing sleeve 154, 154*a* is pivotally attached to two support links 156 by pins 159; the other end of each support link 156 is also pivotally attached to a support shaft 157 which is in turn attached to the dredge vehicle frame by brackets 158. A hydraulic controllable bias cylinder 161 is pivotally attached to the upper support shaft 157 and centered between the support links 156 by cylinder aligning sleeves 160. The bias cylinder piston rod 162 is pivotally connected to the lower steering shaft sleeve 154*a*, by pin 159**.

A remotely controllable steering cylinder 163 is pivotally connected to two steering cylinder supports 164, which are fixedly attached to the upper and lower steering shaft sleeves **154, 154*a*. The steering cylinder piston rod 264 is pivotally connected to a steering arm 166 which is fixedly attached to the steering shaft 152 between the two shaft sleeves 154, 154*a***.

Figure 8:
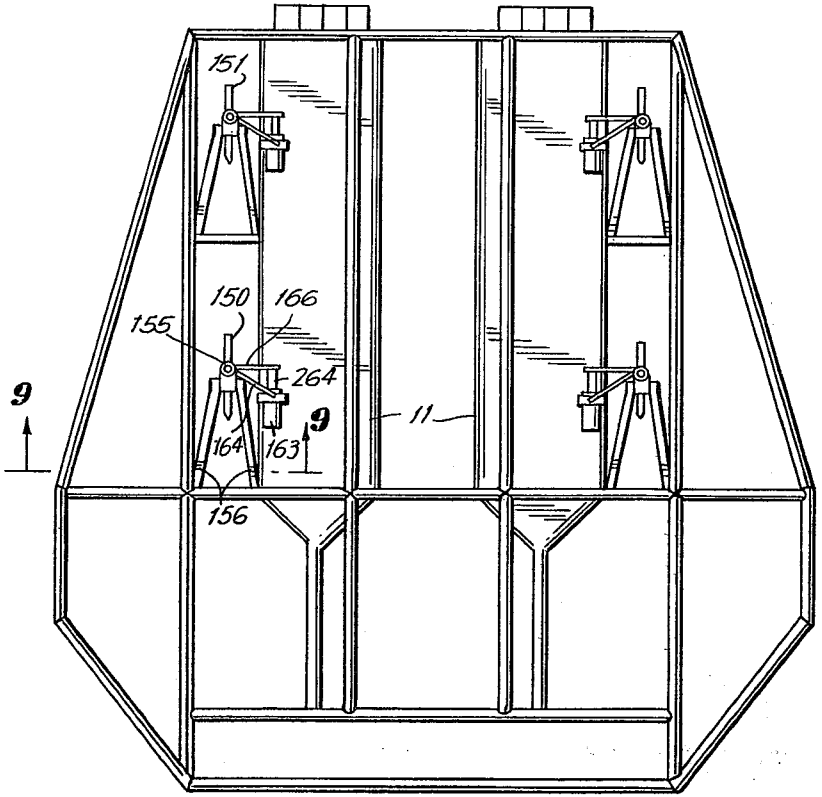
FIG. 8 is a top plan view of a dredge vehicle including an alternative embodiment of steering members.
Figure 10:
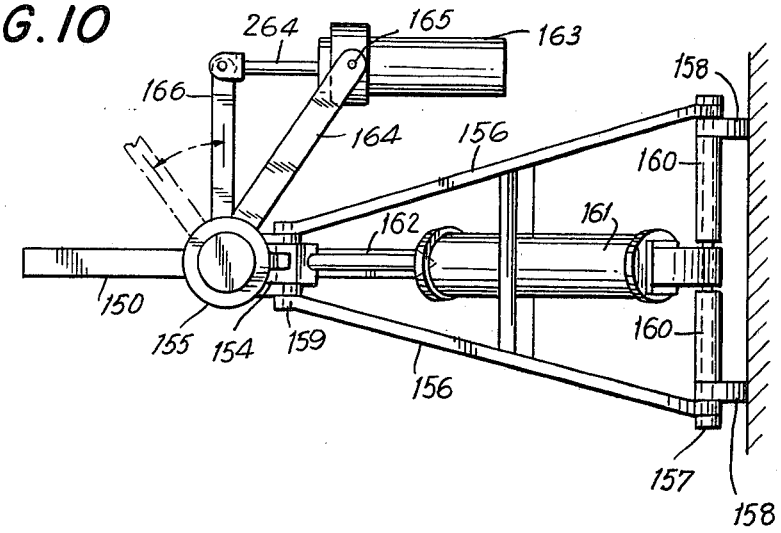
FIG. 10 is a plan view of the steering mechanism of FIG. 9.
Figure 11:
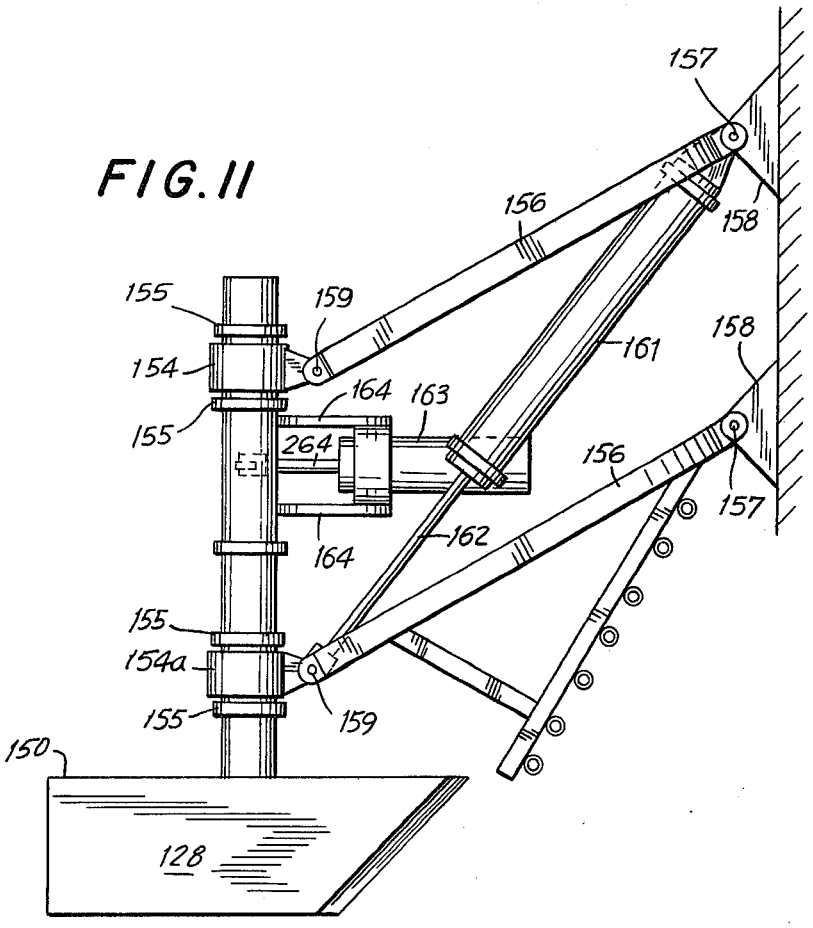
FIG. 11 is an elevation view of the steering mechanism of FIG. 9.

In the configuration shown, when the forward edge of the steering blade 150, 151 strikes a submerged object, the entire steering mechanism, including the steering shaft 152, support links 156, lift cylinder steering cylinder 163 and its supports 164, is pushed upwardly in an arc the radius of which is the length of the support links 156; the lift cylinder piston rod 162 is pushed into the lift cylinder 161. When the steering blade 150, 151 has passed over the submerged object, the lift cylinder piston rod 162 is pushed out of the lift cylinder 161 and the entire steering blade 150 resumes its position below the skid surface. To steer the dredge vehicle, when the remotely controllable steering cylinder 163 pushes the steering cylinder piston rod 264 out of the steering cylinder, the steering arm 166 is pushed outwardly to the left in FIG. 10 and the steering blade 150 is rotated counterclockwise; when all the steering mechanisms in FIG. 8 are rotated counterclockwise, the dredge vehicle will turn toward side B in FIG. 8.

In this alternative, two pairs of tandem steering members can be provided external of the runners 11. In such cases, the steering members can be positioned adjacent the outer edge of each runner 11, or adjacent the inner edge of each runner 11.

The size of the steering members is to an extent significant in determining the amount of control to be exerted. Sufficient transverse surface area, e.g., along surfaces 115, 128, should be present to exert the desired force against the soft mud, e.g., through which the member 150, 151, passes. It has been found, for example, that for a dredge vehicle having runners 30 feet long, and 7 feet wide, the steering member 15, 28 should extend downwardly into the mud approximately 30 inches and the length of, e.g., the steering member 150, 151, should be approximately 5 feet.

The two steering members 150, 151, can have equal steering surface areas, but preferably the forwardmost member 150 can have up to about 20% greater steering surface area.

The dredge vehicle can be supported by a single runner, or skid surface, or by more than two surfaces. Similarly, there need not be an equal number of forward and rear steering members. It is preferred, however, that the steering members be symmetrically placed relative to the centerline of the support surface or surfaces. For example, in the embodiment of FIG. 8, a single forward steering member 12 can be located midway between the two runners 11, as an alternative configuration.

The plane shapes of the side steering surfaces 115, 128 is not critical. The surfaces 115, 128 can be rectangular, parallelograms or other quadrilateral (such as a trapezoid), or triangular. It is preferred that the leading edge slant downwardly, rearwardly, as in FIG. 5 or 11.

The steering system, e.g., the cylinder 163, can be remotely activated hydraulically or electrically, or by other means, from the surface vessel.

The patentable embodiments of this invention which are claimed are:

1. A nonbuoyant, towable, steerable dredge vehicle comprising a chassis frame; towing connector means for connecting the dredge veicle to a tow line; at least one skid surface structurally connected to the chassis frame, and upon which the chassis frame rides when being towed along the ocean floor; a rigid steering member extending downwardly below the skid surface, the steering member being longitudinally elongated and rotatably connected to the dredge vehicle; and remotely controlled activating means to rotate the steering member about a generally vertical axis transverse to the skid surface.

2. The dredge vehicle of claim 1 wherein the steering member, in at least one position of rotation, is longitudinally elongated in a direction substantially parallel to the centerline of the skid surface.

3. The dredge vehicle of claim 1 comprising at least two substantially congruent skid surfaces supporting the chassis frame.

4. The dredge vehicle of claim 1 comprising a pair of steering members in tandem, extending downwardly below the skid surface.

5. The dredge vehicle of claim 4 wherein the steering members are symmetrically located relative to the centerline of the skid surface.

6. The dredge vehicle of claim 5 comprising two support skid surfaces, or runners, the two runners being substantially congruent and each runner supporting a pair of rotatable steering members; the steering members, in at least one position of rotation, being located substantially along and parallel to the centerline of each runner.

7. The dredge vehicle of claim 1 wherein each downwardly extending steering member is reciprocally vertically, movably connected to the dredge vehicle so as to move between a position extending downwardly below the skid surface, and an upwardly retracted position above the skid surface.

8. The dredge vehicle of claim 7 comprising in addition means to bias each downwardly extending steering member to a position extending downwardly below the skid surface.

9. The dredge vehicle of claim 8 wherein the biasing means comprises an hydraulic damper cylinder.

10. The dredge vehicle of claim 1 wherein the means for rotating the steering member comprises hydraulic actuating means.

11. The dredge vehicle of claim 8 wherein the downwardly extending steering member is pivotally secured to the support skid surface from a rearward portion of the member, about an axis substantially parallel to the support surface and about an axis substantially perpendicular to the support surface.

12. The dredge vehicle of claim 1 wherein the steering member rotates about an axis substantially perpendicular to the skid surface.

13. The dredge vehicle of claim 8, comprising in addition a disk member rotatably secured to the skid surface, and wherein the steering member is secured to the disk member.

14. The dredge vehicle of claim 8, comprising two support runners, and at least a pair of steering members located in tandem intermediate the two runners.

15. The dredge vehicle of claim 14, comprising two pairs of steering members, one pair being located in tandem adjacent the inner edge of each runner.

16. The dredge vehicle of claim 4 comprising at least two pairs of steering members located exteriorly of the skid surface.

17. The dredge vehicle of claim 16 comprising in addition two pairs of steering shafts each rotatably attached to the chassis frame and wherein a steering member is secured to each steering shaft.

18. The dredge vehicle of claim 17 wherein the activating means rotates each steering shaft about an axis substantially perpendicular to the skid surface.

19. The dredge vehicle of claim 17 wherein the rotating shaft and the steering member are vertically movable relative to the skid surface.

20. The dredge vehicle of claim 19 wherein the shaft axis is substantially perpendicular to the centerline of the dredge vehicle.

21. The dredge vehicle of claim 19 comprising in addition bias means to bias each shaft and steering member towards a position extending downwardly below the skid surface.

22. The dredge vehicle of claim 21 wherein the bias means comprises an hydraulic cylinder.

* * * * *